United States Patent [19]

Goldfarb et al.

[11] Patent Number: 4,547,166

[45] **Date of Patent: * Oct. 15, 1985**

[54] AMPHIBIOUS SELF-POWERED MINIATURE CAR WITH UNUSUAL CLIMBING CAPABILITY

[75] Inventors: Adolph E. Goldfarb, 1432 SE. Wind Cir., Westlake Village, Calif. 91361; Delmark Everitt, Woodland Hills, Calif.

[73] Assignee: Adolph E. Goldfarb, Northridge, Calif.

[ * ] Notice: The portion of the term of this patent subsequent to Dec. 22, 1998 has been disclaimed.

[21] Appl. No.: 463,999

[22] Filed: Feb. 4, 1983

Related U.S. Application Data

[63] Continuation-in-part of Ser. No. 417,554, Sep. 13, 1982, Pat. No. 4,492,058, which is a continuation-in-part of Ser. No. 233,495, Feb. 11, 1981, abandoned, which is a continuation-in-part of Ser. No. 121,645, Feb. 14, 1980, Pat. No. 4,306,375.

[51] Int. Cl.[4] ..... A63H 23/04; A63H 29/02

[52] U.S. Cl. ..... 446/164; 446/462

[58] Field of Search ..... 46/201, 251, 202, 254, 46/253, 206, 91, 93, 96, 250, 210, 256, 228, 230; 200/16 B; 446/153, 154, 160, 163, 164, 457, 462, 463, 465, 461

[56] References Cited

U.S. PATENT DOCUMENTS

| | | | |
|---|---|---|---|
| 1,375,586 | 4/1921 | Graves | 200/16 B |
| 2,775,062 | 12/1956 | Gibson, Jr., et al. | 446/164 |
| 3,600,847 | 8/1971 | Lakin | 46/96 |
| 3,733,739 | 5/1973 | Terzian | 46/206 |
| 4,306,375 | 12/1981 | Goldfarb et al. | 446/462 |

*Primary Examiner*—Mickey Yu

*Attorney, Agent, or Firm*—Romney Golant Martin & Ashen

[57] ABSTRACT

An amphibious toy vehicle about the length of a "penlight" battery can climb any grade where it will not tip over backward, and can propel itself through water. An "AA" battery powers an electric motor in the four-wheel-drive vehicle. The motor has a double-ended shaft, driving a symmetrical worm-and-worm-gear geartrain. The motor and geartrain are aligned along one side of the chassis; the battery alongside them occupies the rest of the chassis. Both climbing and water-propulsion capability are enhanced by several-times-overscale hollow (to aid flotation) wheels, with pronounced peripheral cleats. A flotation chamber extends beneath the entire chassis. To resist degradation due to dirt, the chassis is substantially sealed against dirt particles, but for economy the sealing is not watertight. To compensate for this, the entire electromechanical system has been made to operate even with the chassis full of water. In particular the on-off switch is "self wiping" and the key motor components are corrosion resistant.

42 Claims, 8 Drawing Figures

AMPHIBIOUS SELF-POWERED MINIATURE CAR WITH UNUSUAL CLIMBING CAPABILITY

RELATED APPLICATIONS AND PATENT

This application is a continuation-in-part of pending U.S. patent application Ser. No. 417,554, filed Sept. 13, 1982 now U.S. Pat. No. 4,492,058, which itself was a continuation-in-part of then-pending U.S. patent application Ser. No. 233,495, filed Feb. 11, 1981, and now abandoned. The latter application was in turn a continuation-in-part of U.S. patent application Ser. No. 121,645, filed Feb. 14, 1980, and issued Dec. 22, 1981, as U.S. Pat. No. 4,306,375.

BACKGROUND

1. Field

This invention is in the field of toy vehicles, and particularly relates to self-powered ultraminiature toy vehicles capable of negotiating in water as well on steep and irregular surfaces.

2. Prior Art

An amphibious toy vehicle offered at one time by the Eldon Company had the capability of operation on rough surfaces or in water. This vehicle was about a foot long, was driven by a battery-powered mechanism, and had a separate screw drive for propulsion in water. The entire body of the vehicle served as flotation hull.

The Eldon toy suffered from the major disadvantage that its size virtually prevented use anywhere except at a real pond or beach. A suitably sized "water/land terrain" for such a toy should be at least ten or twenty times the length of the toy itself, which in the case of the Eldon toy requires a space essentially the size of an entire room. Thus size itself—or, more precisely, size of the toy in relation to the size of ordinary play areas, especially indoor play areas—can be of great importance in this particular field of toys.

The Eldon toy also had the important disadvantage of depending exclusively upon its entire outer hull for flotation. If the hull developed a leak below the water line, the toy would fill with water and would sink. If the vehicle sank, its drive mechanism would be completely exposed to water and it would shortly rust and in due course become inoperative. In addition the toy had a screw-type propulsion system for operation in water, adding additional complexity and also adding a potential point of leakage—one very likely to be below the water line.

Many water-play toys have been made to resemble boats or water creatures and to propel themselves along the surface of a body of water. Some of these toys depended for propulsion (but not to any significant extent for flotation) upon rotating wheels or other rotating elements rotatably fixed to the sides of the toys. For example, the Tomy Company has offered bathtub toys configured as toy penguins, fish, dolphins, frogs, and so forth, which float and whose limbs rotate to propel them. The same company has offered bathtub toys configured as toy paddlewheel boats, with lateral, rotatably fixed propulsive paddlewheels.

These toys are all made for water use exclusively, rather than for amphibious use. In the case of the paddlewheel toys, it does not appear that the paddlewheels would both at the same time touch a surface on which the toys were placed, and, even if they would, neither the paddlewheels nor the toy bodies generally were suitably configured to provide good traction or effective operation over rough surfaces. In the case of the rotating-limb toys, the dynamic visual effect of such toys operating on a dry surface would be to lurch forward erratically, producing—at best—generally a comic or silly impression.

All of these tube toys may well be adequate for their intended purpose. They would not be suitable for a toy amphibious vehicle that is intended to suggest the operation of a real amphibious vehicle—e.g., a swamp buggy or a military amphibious carrier. Such a real vehicle should operate very tenaciously and effectively over rough surfaces as well as operate in water, to produce an exciting, "adventure" kind of impression rather than one that is comic or silly.

BRIEF SUMMARY OF THE INVENTION

Our invention provides a self-propelled amphibious miniature toy vehicle for operation along the surface of a pool of water and also on a steep, irregular nonwater surface.

Preferably the vehicle is used with some means for providing electrical energy to power the vehicle; we refer to these means as "electrical battery means." They typically include an elongated dry-cell battery that has a longitudinal axis. When such "battery means" are in use with the vehicle, the vehicle has major weight components positioned to provide a generally symmetrical, compact, balanced and relatively low arrangement. These constraints may be in a certain sense regarded as the context in which our invention operates. As further discussed below and as defined by the appended claims, however, with respect to some of the preferred embodiments of our invention they are also part of the invention itself.

Certain preferred embodiments of our invention have a frame, hollow "wheel means" mounted to the frame for rolling rotation, and an electric motor mounted to the frame and operatively connected to drive at least one of the "wheel means."

We intend the phrase "wheel means" to encompass not only wheels but various forms and types of tires, cleating, paddling structures, half-track- or tank-style endless belts, and/or even skids at one end in combination with rotary driving structures at the other. The wheel means are mounted to the chassis for rolling rotation (of at least some member, such as the driving rollers in the case of a half-track belt) about at least one laterally extending axis.

In the instance of relatively more conventional wheel means, the wheel means have more than one such axis—generally, mutually parallel but spaced-apart front and rear axes. In certain preferred embodiments of our invention the distance between the front and rear axes is generally about two inches.

The wheel means preferably extend below the frame, to effect propulsion of the vehicle along such a nonwater surface, when the vehicle is placed on such a surface. The volume-to-weight ratio of each of the wheel means themselves, however, is sufficiently high that when the vehicle is placed in water the wheel means contribute significantly to flotation of the vehicle.

We prefer to provide cleated tires mounted to the wheel means. The cleats should be adapted and sufficiently pronounced to propel the vehicle along a water surface—provided that generally the bottom half of each wheel means is submerged in the water and generally the top half of each wheel means is above the water.

The overall flotation characteristics of the vehicle are, accordingly, made such that when the vehicle is placed in a sufficiently deep pool of water the vehicle floats just that way—i.e., with very generally the bottom half of each wheel means submerged and very generally the top of each wheel means above the water.

Preferred embodiments of our invention also have a separate flotation chamber affixed to the frame. This chamber must be adapted and sized to contribute significantly to flotation of the vehicle in water.

In principle, any compartment that is provided to house the working internal parts of an amphibious toy vehicle can be sealed effectively enough to contribute significantly to flotation. If this is done, a separate flotation compartment is unnecessary—and this arrangement is within the scope of our invention.

It is not, however, in accordance with the embodiments of our invention which we prefer. Keeping the working internal parts of an amphibious toy vehicle dry is relatively very expensive, since seals must be provided for the shafts that drive the wheel means and for the on-off control, as well as along passive seams. We therefore prefer to construct embodiments of our invention on the assumption that water will enter any compartment that may be provided to house the working parts.

Thus we make the working parts operate even when fully submerged in water. Furthermore, since any such compartment that is full of water will not contribute at all to flotation, we prefer to construct embodiments of our invention with adequate flotation provided by the wheels and flotation chamber—not depending at all upon any mechanism compartment for flotation.

By "contribute significantly to flotation of the vehicle" we therefore mean to include, as one extreme case, that the flotation chamber in combination with the wheel means is sufficient to float the vehicle. That constraint, however, need not necessarily be met for a toy vehicle to be within the scope of our invention: a lesser fraction of the necessary flotation may be supplied by a flotation chamber, so long as the fraction is significant. (Yet other embodiments of our invention may require no flotation chamber at all.)

We find it particularly advantageous to provide a flotation chamber that is generally coextensive in width and length with the frame of the vehicle, and disposed below the frame. The wheel means must then extend below the flotation chamber. By making the chamber coextensive with the frame, a desirably compact arrangement of parts is preserved, and the external appearance of the vehicle can be made generally compatible with that of nonamphibious vehicles such as those described in the above-mentioned U.S. patent.

Returning to the subject of operability of the toy mechanism even when fully exposed to water, preferred embodiments of our invention should also have some means for effecting operative electrical connection between the motor and a battery, when such a battery is in place in the toy. We refer to these means as "contact means," and they should in particular be corrosion-resistant, electrically conductive, and fixed to the frame. They should be electrically connected to the motor, and they should be positioned to contact the terminals of a battery when such a battery is mounted in the frame.

Cooperating with the contact means there should also be means for operatively mounting a battery in the frame to power the motor.

The contact means, moreover, also preferably include an electrical on-off switch that is fixed to the frame. This switch has a self-wiping action that protects the switch against any corrosion that may result from exposure of the switch to water.

Such a switch is effectively provided by the following construction. First, there is a first corrosion-resistant formed metal contact fixed to the frame, and disposed and adapted for electrical contact with one terminal of a battery—when the battery is in place. This metal contact has a springy portion, whose purpose will shortly be explained.

Next, there is a second corrosion-resistant formed metal contact, also fixed to the frame and also having a springy portion. This contact, however, is disposed and adapted for electrical contact with the motor rather than with the battery.

Finally, there is a bridging corrosion-resistant formed metal contact that is slidably fixed to the frame. When actuated, this contact slides between two positions. In a first position it is not touching at least one of the first and second contacts mentioned above. In a second position it does touch both of the contacts—at their respective springy portions.

The two springy portions of the respective two metal contacts press firmly against the bridging contact when the bridging contact is in the second position. The direction of motion of the bridging contact, relative to the directions in which the springy portions press, is such that in the course of its sliding motion the bridging contact firmly wipes the springy portions of the first and second contacts where they touch the bridging contact.

This firm wiping action tends to keep the touching areas free from corrosion and thus electrically conductive after the switch parts have been exposed to water, and even while they are submerged.

In addition the motor must be made operable under similar conditions. We have found that this can be done by using a motor whose electrical brushes and bearings are of a corrosion-resistant material, and whose electrical windings are of insulated wire. In particular, enameled copper wire is suitable.

In preferred embodiments of our invention, as stated earlier, the compactness and weight distribution of the parts of the toy vehicle are to be considered important features or elements of our invention. The following six paragraphs elaborate upon these features.

First, the frame defines a chassis with upright walls, and the chassis walls in turn define an interior compartment. Second, the wheel means are hollow wheel means mounted to the chassis for rolling rotation about respective mutually parallel front and rear axes. These axes are spaced apart, generally by about two inches.

Third, the electrical motor is mounted in the interior compartment. We prefer to provide some means in this interior compartment to releasably support the earlier-mentioned electrical battery means. Typically the electrical battery means include an elongated dry-cell battery which has a pronounced longitudinal axis, and the support means should releasably support the battery means with that longitudinal axis extending substantially front-to-back of the vehicle.

In accordance with the preferred size mentioned in the preceding paragraph, the vehicle is quite small, with a very short wheelbase (when there are front and rear wheel means)—so that a single "Penlight" battery cell extends at least substantially the full distance between the previously-mentioned front and rear axes.

Fourth, the vehicle also is provided with some means for electrically connecting the battery means, when the latter is in place, to the motor—so that the battery means power the motor.

Fifth, transmission means are mounted in the interior compartment. These means include a speed-reduction mechanism connecting the motor driveshaft to both the front wheel means and the rear wheel means, to transmit rotation from the driveshaft to the wheel means. This mechanism is made to effect this transmission with reduced speed and increased power—i.e., with a mechanical advantage between the motor shaft and wheel means. We have found that a mechanical advantage between 55:1 and 65:1 is particularly preferable. A mechanism at each end of the motor using a worm and worm gear is especially well-suited to this purpose.

Sixth, at least major portions of these major weight components—the transmission means, the motor, and the battery means when in place—are at about the same height as the front and rear wheel means. Further, these three major weight components, when all are in place, substantially fully occupy the interior compartment.

We have found that observing these constraints upon our toy vehicle design provides a remarkably effective climbing-toy operation. The characteristics of such operation have been described at length in the earlier-mentioned patent. Briefly, however, these characteristics encompass the ability to negotiate steep and irregular surfaces without tipping over—either backward or sideward.

By carrying these constraints into the configuration of a miniature amphibious toy vehicle, we have been able to obtain the entirely new result of an amphibious vehicle which can propel itself along the surface of a pool of water and which, upon emerging from such a pool and without the necessity for any adjustments or new control settings—can proceed to operate as a climbing toy. This result presents to the user (i.e., generally a child) of such miniature vehicles a striking and extremely appealing overall effect.

When the constraints just discussed are combined with certain other features of our invention previously discussed, the impact of the toy is further enhanced.

In addition it is beneficial to provide a toy vehicle body that is mounted to the frame. The body advantageously conceals the motor, worms, worm gears, and dry-cell mounting means (as well as the dry cell itself, when the latter is in place), and is a fantasy design or a scale model derived from at least one real vehicle body. The vehicle-body scale used should be such that the axle spacing turns out to match the spacing between the axes of wheel-means rotation of the toy. The outside diameter of the tires, however, should be at least three times overscale, to produce an exaggerated effect of power and traction—as well as to help supply the buoyancy or flotation capability discussed previously.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

Figure 1:
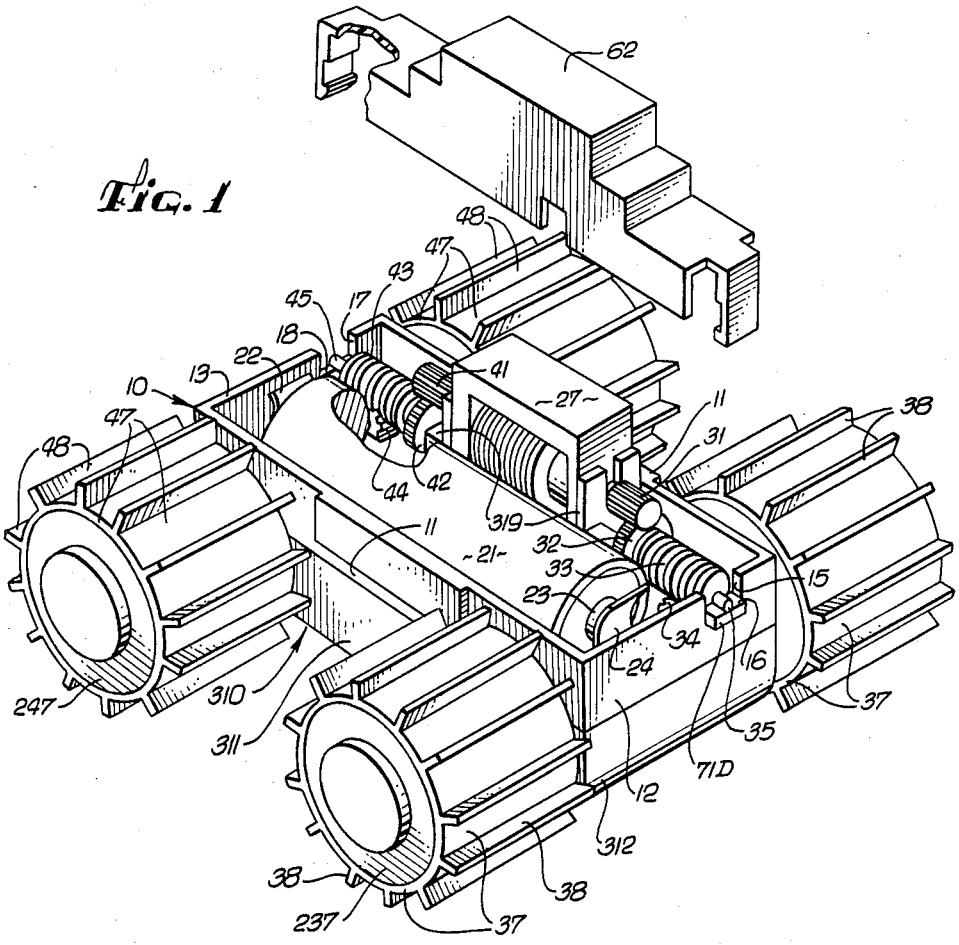
FIG. 1 is a perspective view of a preferred embodiment of our invention, with a battery in place but partly cut away, and with a mechanism cover shown removed to illustrate the internal parts.

As shown in FIGS. 1, 5, 6, and 8, a preferred embodiment of our invention is built in and around a chassis 10 consisting of upstanding left and right side walls 11, front end wall 12 and rear end wall 13, all erected about the periphery of an extended horizontal floor 19. The front end wall 12 may have a forward protrusion (not shown) which supports and contains functional connections for a small light bulb, and which also supports a transparent light distributor, all as illustrated and described in detail in the previously-mentioned patent.

The front end wall 12 also has a generally rectangular slot 15, 16 formed in it; and the rear end wall 13 has a similar slot 17, 18—both slots being provided for a purpose to be described.

The chassis 10 serves both as a frame to support and as a partial enclosure to conceal and protect the power source and train.

Mounted below the chassis for rolling rotation with respect to it are two mutually parallel but spaced-apart axles, an axle 36 near the front and an axle 46 near the rear of the chassis. Secured to the ends of these two axles 36 and 46 are respective pairs of wheels—front wheels 237 and rear wheels 247, with corresponding tires 37 and 47, which are thus in effect mounted to the frame for rolling rotation about respective mutually parallel but spaced-apart axes (the centerlines of the axles 36 and 46), one such axis being in front of the other.

Mounted atop the chassis floor 19 at a position between the two axles (or wheel rotation axes) is an electric motor 27. The motor 27 is located against one of the side walls 11, and oriented so that its driveshaft 283 (FIG. 5) is perpendicular to the two wheel-rotation axes. This motor is of a type whose driveshaft extends both fore and aft from the motor housing. The motor 27 is secured against longitudinal motion by two blocks 319, which are integral with the chassis floor 19 and the adjacent side wall.

Mounted to the two ends of the motor driveshaft 283 are respective drive pinions 31 at the front and 41 at the rear, which are firmly secured for rotation with the driveshaft.

Below the pinions 31 and 41 and meshed with them are respective spur gears 32 and 42, which rotate on corresponding shafts 35 and 45 oriented parallel to the driveshaft. The spur-gear shafts 35 and 45 are each journalled at one of their respective ends into one of the motor blocks 319, and at the other of their respective ends into the corresponding end wall 12 or 13, in a manner to be detailed below. Sharing the spur-gear shafts 35 and 45 with the spur gears 32 and 42, and firmly secured to those spur gear shafts to rotate with them, are respective worms 33 and 43.

Below these worms 33 and 43, and oriented and disposed to mesh with them, are respective worm gears 34 and 44—each oriented to rotate about axes parallel to the axes of wheel rotation. The worm gears 34 and 44 and the respective wheel pairs 237 and 247 are mounted conaxially (that is, together on the same respective shafts 36 and 46). The gears and wheels are fixed to their corresponding axles, for rotation in common; thus each of the worm gears 34 and 44 drives a respective pair 237 or 247 of wheels.

Thus the wheels may be driven by a symmetrical power train having but two stages and yet providing very high mechanical advantage between the motor driveshaft and the axles, and occupying a narrow space along one side of the chassis 11—and thus leaving the greater width of the chassis for a "penlight" battery 21 (whose positive pole appears at 23), and the appropriate electrical connectors 22 and 24.

From the fact that the dry-cell battery 21 appearing in FIG. 1 is only a size-AA penlight type, the remarkably small overall size of the vehicle may be seen dramatically. Yet, due to the simplicity of the novel drive train, it is not necessary to use highly miniaturized or high-precision gears.

A miniature scale-model vehicle body (such as 74 in FIGS. 2 through 4) is fitted to the chassis 10, and held on by appropriate detents formed in the outsides of the chassis walls 11 and/or 12 and 13. The body 74 snaps on and off to permit easy changing of the battery 21. The body style typically is derived from a real vehicle body, with some adjustment of proportions to fit the chassis.

To obtain excellent traction on irregular surfaces and to permit locomotion of the vehicle in water, the tires 37 and 47 are made of resilient rubber or plastic, configured with extremely exaggerated or pronounced cleats such as 38 and 48.

Some details of the construction of this preferred embodiment of our invention include protective drive-gear wells, such as the rear well 73, encasing the worm gears 34 and 44 respectively; and the drive-mechanism cover 62. The cover 62 protects the motor 27, the worms 33, 43, and worm gears 34, 44, and the pinions 31, 41 against damage when the user installs or changes a battery. The cover also has a side wall which isolates the drive mechanism from the battery-mounting area, while providing an electrical connection path via a slot. It will be noted, however, that the cover 62 does not function to keep water out of the motor or mechanical parts, and does not cover the switch (to be described shortly) at all.

The forward end of the forward worm shaft 35 rests in a half-journal formed in the horizontal bottom surface 16 of the slot 15, 16. Likewise the rearward end of the rear worm shaft 45 rests in a half-journal formed in the horizontal bottom surface 18 of the rear slot 17, 18. The upper halves of these two journals are provided by portions of the drive cover 62.

Though below the chassis floor proper 19, the axles 36 and 46 are within the chassis enclosure by virtue of axle wells 19W (FIG. 6), which extend to the two sides of the chassis and serve as axle bearings.

The electrical circuitry of the toy is generally conventional: battery 21 applies power through contacts 22 and 24 (FIGS. 1, 5, 6, and 7), wire 224, and switch 222-223-324-322-323 to the motor 27. The electrical switching mechanism, however, is in part novel, as will shortly be explained.

As to the battery polarity, the motor connections, and the "handedness" or pitch direction of the worms used in our invention, it is to be understood that any *two* of these factors may be reversed and the toy vehicle will operate in the same direction. For instance, if the battery polarity is reversed and the handedness of the worms is also reversed, the vehicle will still move "forward" as defined by the front/rear terminology used in this document.

Figure 5:
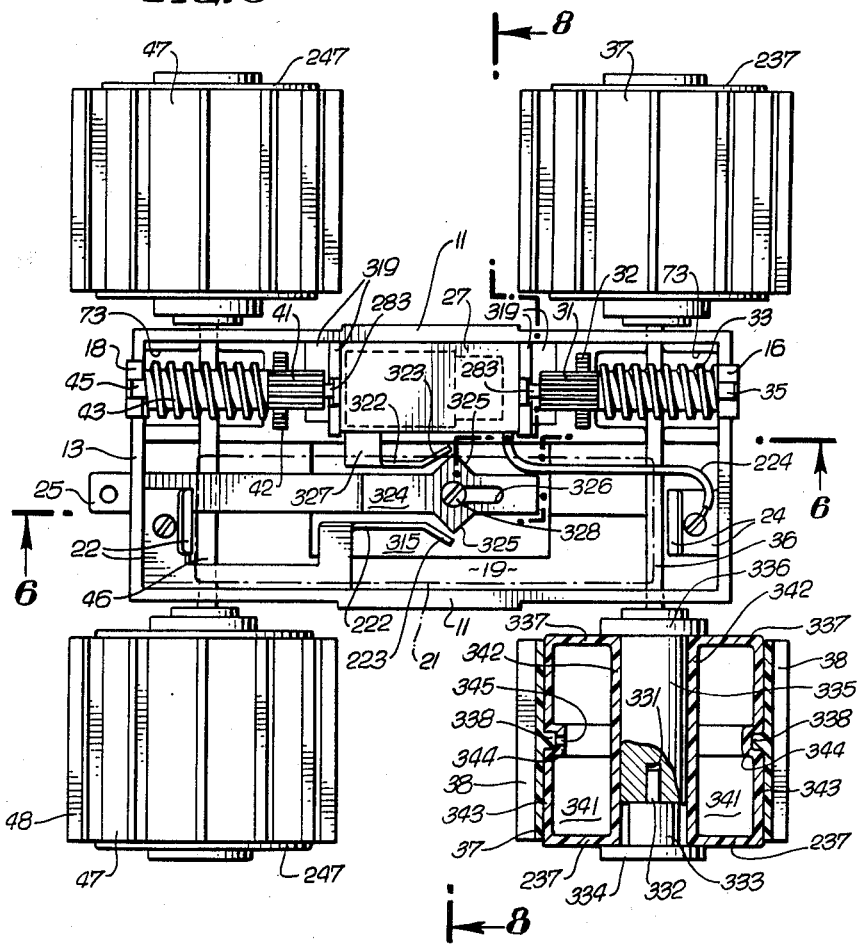
FIG. 5 is a plan view of the FIG. 1 embodiment, but without the battery or mechanism cover.
Figure 6:
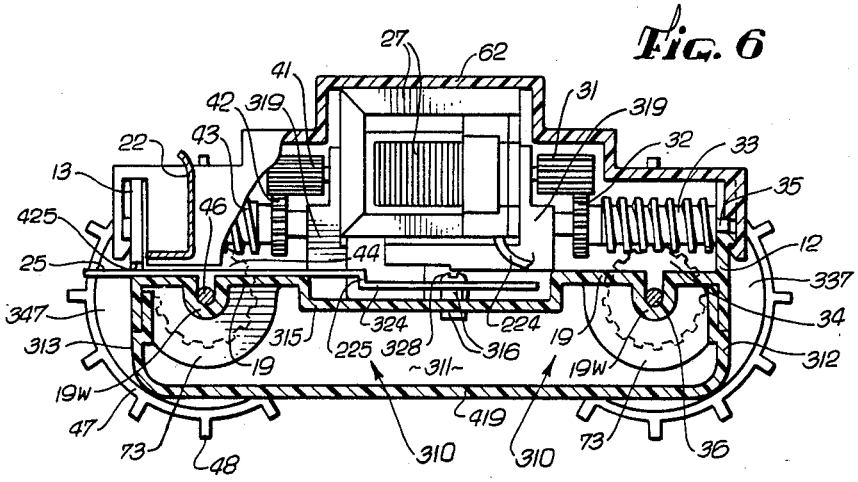
FIG. 6 is a side elevation of the FIG. 1 embodiment, taken along the line 6—6 of FIG. 5.
Figure 7:
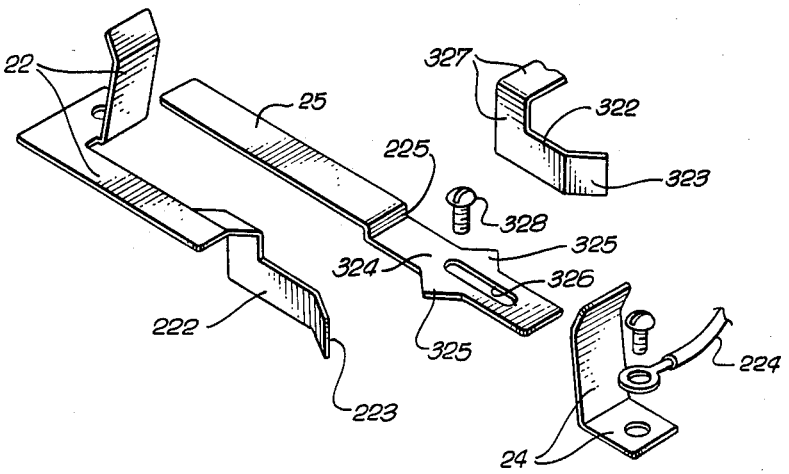
FIG. 7 is an exploded perspective view of the electrical contacts and switch for the FIG. 1 embodiment, shown dissociated from the chassis.
Figure 8:
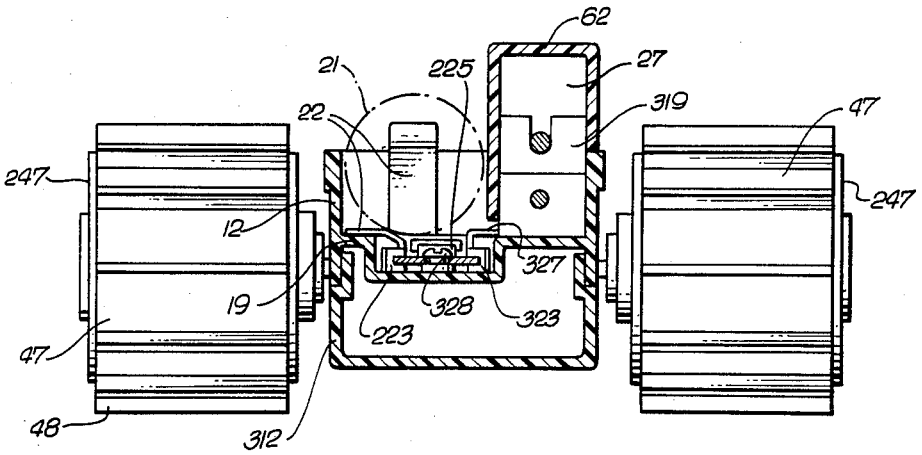
FIG. 8 is an end elevation of the same embodiment, partly in section and taken along the line 8—8 of FIG. 5.

FIG. 5 shows (also see FIG. 7) that the first (rear battery) metal contact 22 is screwed to the floor 19, and is extended along the side of the battery into a recessed section 315 of floor 19, and is integral with a springy metallic contact portion 222. This springy portion 222 includes an outwardly flared guide section 223. The front battery contact 24, too, is screwed to the floor 19, and is connected by a wire 224 to an appropriate contact point on the motor 27. Another contact point (the ground) on the motor is connected to a second metal contact 327, which is integral with a springy contact portion 322—which includes an outwardly flared guide section 323.

The user may turn the motor 25 on and off by operating the switch handle 25 (FIGS. 5 and 6) rearward and frontward, respectively. This handle slides in and out through the rear wall 13 of the chassis 10, through a passage 425 (FIG. 6) that is formed in the rear wall 13 just above the floor 19.

Integral with the handle 25, though offset downwardly at 225, is a bridging metal contact 324 that is slidably fixed to the recessed floor section 315 by a screw 328. The screw 328 screws into a hole which is given sufficient depth for an adequate number of threads by bosses 316 formed above and below the recessed floor section 315 of the frame or chassis.

The bridging contact 324 has a slot 326 through which the screw 328 passes, thus permitting the bridging contact 324 to slide rearward and forward (through the passage 425 in the rear wall 13), while remaining fixed to the floor section of the frame or chassis.

The bridging contact 324 also has laterally extending enlargements that touch neither of the contacts 222–223 and 322–323 when the bridging contact 324 is actuated to slide into a first (forward) position—as shown in FIG. 5. In this first position the switch is "off." It can be seen that the equivalent "off" condition will be obtained as long as the bridging contact 324 is not touching at least one (either one) of the previously mentioned first and second contacts.

However, the laterally extending enlargements 325 touch both of the contact springy portions 222–223 and 322–323 when the bridging contact 324 is actuated to slide into a second (rearward) position. In this second position the switch is "on," and the springy portions 222–223 and 322–323 press firmly against the bridging contact 324.

The forward-backward direction of motion of the bridging contact 324, relative to the sideward directions in which the springy portions 222–223 and 322–323 press, is such that in the course of its sliding motion the bridging contact firmly wipes the springy portions of the first and second contacts where they touch the bridging contact. This self-wiping action, as previously explained, preserves operability of the circuit even after extended exposure to water.

Secured (as by gluing) to the underside of the chassis 10 is a flotation chamber 310, having side walls 311, a front wall 312, a rear wall 313, and a floor 419. The flotation chamber is "capped" by the bottom floor of the chassis proper—specifically, by floor section 19, recessed floor section 315, axle wells 19W, and worm-gear wells 73. Formed in the chamber floor 419 is a drain hole 420, which in use is plugged by a stopper 421.

As best shown in FIG. 5, each wheel (such as the front wheel 237) is formed as a hollow toroidal structure, preferably (for maximum volume) squared off with outboard annular planar surface 237, inboard annular planar surface 337, an interior annular generally cylindrical surface 342, and an exterior annular generally cylindrical surface 343.

Formed in the exterior surface 343 is a circumferential groove 344. Engaging this groove 344 is a mating inward-directed ridge 338 formed on the internal annular surface of the tire 37. The groove 344 and ridge 338 cooperate to retain the tire 37 in place on the wheel 237, and the ridge 338 also seals a drain hole 345 that is defined in the wheel 237 within the groove 344.

Generally equivalent results will be obtained by configuring the cross-section of the tire 37 with sufficient thickness near its center (laterally) to permit forming a groove (rather than a ridge) in the internal annular surface of the tire; and also forming a ridge (rather than a groove) in the peripheral surface of the wheel.

The toroidal wheel 38 is mounted to the axle 36 by a cylindrical wheel hub 335, which fits snugly within the wheel 38 and whose flange 336 locates the inboard surface 337 of the wheel 38. The wheel 38 is retained at its outboard surface 237 by the flange 334 of a cylindrical hub cap 333. The hub cap 333 is located relative to the hub 335 by a central pin 332 of the hub cap 333, which fits into a central hole 331 in the end face of the hub 335. The hub cap 335 is held in place by glue.

The cleated tires 37, 47 need not extend the entire width of the wheels 237, 247.

Taking the distance between axles 36 and 46 as compatible with the dimensions of the model vehicle body 74—that is to say, assuming that the axles 36 and 46 are spaced apart by a distance which is correct for the scale of the model body 74—it may now be asked how the scale of the tires 237, 247 compares with the scale of the body and wheelbase. It will be seen from FIGS. 2, 3, and 4 that the tires 237 and 247 are substantially "over-scale"—that is, oversize with respect to the otherwise generally consistent model body and wheelbase.

Due to the very pronounced cleats 38 and 48, the vehicle can find a grip on all but the slipperiest surfaces, even on very steep grades; and due to the high mechanical advantage of the drive train will climb any surface it can rest on and grip. We have found that the preferred embodiment illustrated in FIG. 1 can rest on and grip surfaces of virtually any substance at grades up to about 30°, and with surfaces of high-traction substance such as styrofoam it can operate at grades up to about 40°. The limiting factor at 40° is that the weight of the vehicle is centered at a point very nearly above the rear wheel axle, so that the vehicle is subject to tipping over backward when it bounces over a small bump.

Figure 4:
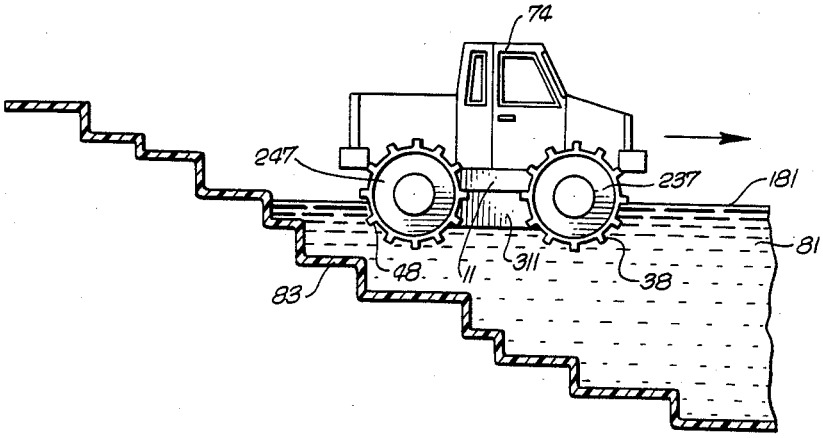
FIG. 4 is a similar side elevation as in FIG. 3 but showing the terrain partly filled with water and the FIG. 1 embodiment operating along the surface of the water.

Moreover, the flotation chamber 310 and the hollow wheels 237, 247 are so sized and proportioned that when the toy vehicle is placed in water it floats generally as shown in FIG. 4—with generally the bottom half of each wheel below the surface 181 of the water 81, and with generally the top half of each wheel above the surface 181. In this condition the cleats 38 and 48 propel the vehicle forwardly, as at 157 in FIG. 4, along the water surface 181.

Overall flotation characteristics vary with mechanical details, materials, wall thicknesses, and so forth. Based on this disclosure, however, a person skilled in the art of mechanical design will perceive how to determine suitable proportions and dimensions for the flotation chamber and wheels, to obtain the flotation behavior herein described.

Figure 3:
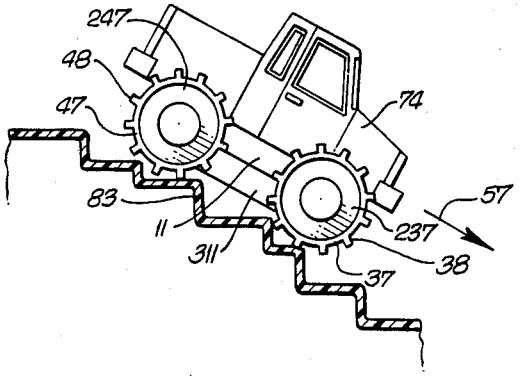
FIG. 3 is a side elevation, with the terrain shown in section, of the same scene as in FIG. 2.
Figure 2:
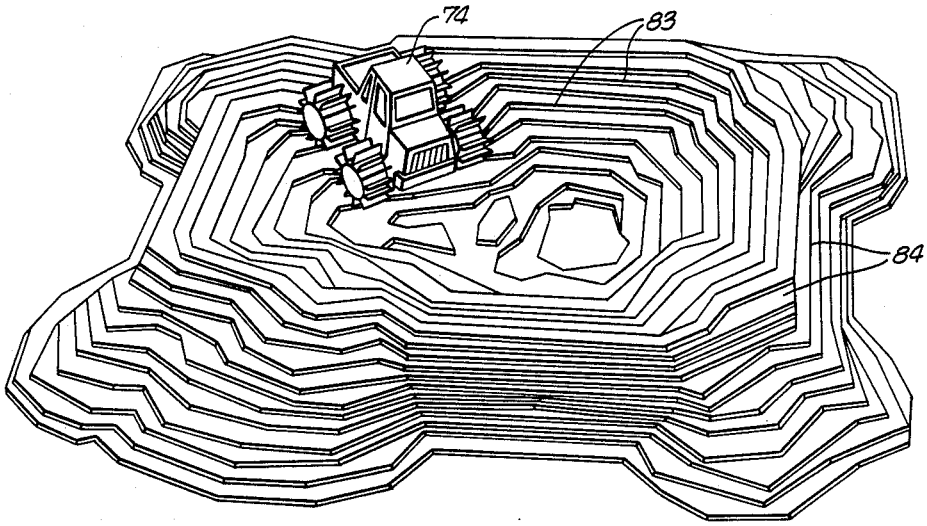
FIG. 2 is a perspective view of the FIG. 1 embodiment shown operating upon a toy terrain that is suitable for being filled or partly filled with water to exercise the amphibious capabilities of the invention.

A toy terrain such as 83, 84 in FIGS. 2 through 4 is advantageously supplied with the toy vehicle. The ascending outer surface 84 provides an irregular climbing surface, and also supplies the necessary height for an upwardly concave inner surface 83, which as already indicated can be filled with water 81. Due to the very small size of the toy vehicle, the toy terrain may be smaller than two feet in overall diagonal dimension and yet provide sufficient "terrain" for enjoyable amphibious operation of the toy vehicle.

For the preferred embodiment of FIG. 1 we use a motor whose unloaded rotational speed is 3,000 to 10,000 revolutions per minute. The motor of course slows down when the vehicle is climbing a steep grade. We provide a 2:1 gear ratio between the pinion and spur gears 31, 32 and 41, 42; and a further step-down of 30:1 or greater between the worm and worm gear, for an overall reduction or mechanical advantage of approximately 60:1.

It will be understood that the foregoing disclosure is intended to be merely exemplary, and not to limit the scope of our invention—which is to be determined by reference to the appended claims.

We claim:

1. A self-propelled amphibious miniature toy vehicle for operation along the surface of a pool of water and on a steep, irregular nonwater surface, and for use with electrical battery means that comprise an elongated dry-cell battery having a longitudinal axis; said vehicle having, when such battery means are in use therewith, major weight components positioned to provide a generally symmetrical, compact, balanced and relatively low arrangement; said vehicle comprising:

a frame;

hollow wheel means mounted to the frame for rolling rotation and extending below the frame to effect propulsion of the vehicle along such nonwater surface, the volume-to-weight ratio of each of said wheel means being sufficiently high to contribute significantly to flotation of the vehicle in water; and an electric motor mounted to the frame and operatively connected to drive at least one of the wheel means; and wherein:

the frame defines a chassis having upright walls defining an interior compartment;

the hollow wheel means comprise hollow front wheel means and hollow rear wheel means mounted to the chassis for said rolling rotation about respective mutually parallel but spaced-apart front and rear axes, the distance between the front and rear axes being generally about two inches;

the electric motor is mounted in the interior compartment, and has a driveshaft; and the vehicle further comprises:

means mounted in the interior compartment to releasably support such electrical battery means in the compartment with such longitudinal axis of such battery means extending substantially front-to-back of the vehicle and extending at least substantially the full distance between the front and rear axes;

means on the chassis for electrically connecting such battery means, when supported in the supporting means, to the motor, so that such battery means power the motor; and transmission means mounted in the interior compartment and comprising a speed-reduction mechanism connecting the motor driveshaft to both said front and said rear wheel means to transmit rotation from the driveshaft to the wheel means with reduced speed and with increased power;

at least major portions of the transmission means, the motor, and such battery means, when such battery means are supported in the supporting means, being at approximately the same height as the front and rear wheel means; and the transmission means, the motor, and such battery means, when such battery means are supported in the supporting means, substantially fully occupying the interior compartment.

2. The vehicle of claim 1, also comprising cleated tires mounted to the wheel means, the cleats being adapted and sufficiently pronounced to propel the vehicle along such a water surface when generally the bottom half of each wheel means is submerged in such water and generally the top half of each wheel means is above such water.

3. The vehicle of claim 2, also comprising a separate flotation chamber affixed to the chassis and adapted and sized to contribute significantly to flotation of the vehicle in such water.

4. The vehicle of claim 3, wherein the flotation chamber is generally coextensive in width and length with the chassis, and disposed below the chassis.

5. The vehicle of claim 4, wherein:

the electrical connecting means comprise corrosion-resistant electrically conductive contact means, electrically connected to the motor and positioned to contact the terminals of such a battery when such a battery is mounted in the frame, to effect operative electrical connection between such a battery and the motor;

said contact means including an electrical on-off switch that is fixed to the frame and that has a self-wiping action that protects the switch against any corrosion that may result from exposure of the switch to such water.

6. The vehicle of claim 2, wherein:

the electrical connecting means comprise corrosion-resistant electrically conductive contact means, electrically connected to the motor and positioned to contact the terminals of such a battery when such a battery is mounted in the frame, to effect operative electrical connection between such a battery and the motor;

said contact means including an electrical on-off switch that is fixed to the frame and that has a self-wiping action that protects the switch against any corrosion that may result from exposure of the switch to such water.

7. The vehicle of claim 1, also comprising a separate flotation chamber affixed to the chassis and adapted and sized to contribute significantly to flotation of the vehicle in such water.

8. The vehicle of claim 7, wherein the flotation chamber is generally coextensive in width and length with the chassis, and disposed below the chassis.

9. The vehicle of claim 8, wherein:

the electrical connecting means comprise corrosion-resistant electrically conductive contact means, electrically connected to the motor and positioned to contact the terminals of such a battery when such a battery is mounted in the frame, to effect operative electrical connection between such a battery and the motor;

said contact means including an electrical on-off switch that is fixed to the frame and that has a self-wiping action that protects the switch against any corrosion that may result from exposure of the switch to such water.

10. The toy vehicle of claim 1, wherein:

the electrical connecting means comprise corrosion-resistant electrically conductive contact means, electrically connected to the motor and positioned to contact the terminals of such a battery when such a battery is mounted in the frame, to effect operative electrical connection between such a battery and the motor;

said contact means including an electrical on-off switch that is fixed to the frame and that has a self-wiping action that protects the switch against any corrosion that may result from exposure of the switch to such water.

11. A self-propelled amphibious miniature toy vehicle for operation along the surface of a pool of water and on a steep, irregular nonwater surface, and for use with electrical battery means that comprise an elongated dry-cell battery having a longitudinal axis; said vehicle having, when such battery means are in use therewith, major weight components positioned to provide a generally symmetrical, compact, balanced and relatively low arrangement, while also providing adequate nonwater-surface clearance in the area between the front and rear wheels; said vehicle comprising:

a frame;

wheel means mounted to the frame for rolling rotation and extending below the frame to effect propulsion of the vehicle along such nonwater surface;

an electric motor mounted to the frame and operatively connected to drive at least one of the wheel means; and cleated tires mounted to the wheel means, the cleats being adapted and sufficiently pronounced to propel the vehicle along such a water surface when generally the bottom half of each wheel means is submerged in such water and generally the top half of each wheel means is above such water; and wherein:

the overall flotation characteristics of the vehicle are such that when the vehicle is placed in a sufficiently deep pool of water the vehicle floats with generally the bottom half of each wheel means submerged in such water and generally the top half of each wheel means above such water;

the frame defines a chassis having upright walls defining an interior compartment;

the wheel means comprise front wheel means and rear wheel means mounted to the chassis for said rolling rotation about respective mutually parallel but spaced-apart front and rear axes, the distance between the front and rear axes being generally two inches;

the electric motor is mounted in the interior compartment, and has a driveshaft; and the vehicle further comprises:

means mounted in the interior compartment to releasably support such electrical battery means in the compartment with such longitudinal axis of such battery means extending substantially front-to-back of the vehicle and exttending at least substantially the full distance between the front and rear axes;

means on the chassis for electrically connecting such battery means, when supported in the supporting means, to the motor, so that such battery means power the motor; and transmission means mounted in the interior compartment and comprising a speed-reduction mechanism connecting the motor driveshaft to both said front and said rear wheel means to transmit rotation from the driveshaft to the wheel means with reduced speed and with increased power;

at least major portions of the transmission means, the motor, and such battery means, when such battery means are supported in the supporting means, being at approximately the same height as the front and rear wheel means; and the transmission means, the motor, and such battery means, when such battery means are supported in the supporting means, substantially fully occupying the interior compartment.

12. The vehicle of claim 11, also comprising a separate flotation chamber affixed to the chassis and adapted and sized to contribute significantly to flotation of the vehicle in such water.

13. The vehicle of claim 12, wherein the flotation chamber is generally coextensive in width and length with the chassis, and disposed below the chassis.

14. The vehicle of claim 13, wherein:

the electrical connecting means comprise corrosion-resistant electrically conductive contact means, electrically connected to the motor and positioned to contact the terminals of such a battery when such a battery is mounted in the frame, to effect operative electrical connection between such a battery and the motor;

said contact means including an electrical on-off switch that is fixed to the frame and that has a self-wiping action that protects the switch against any corrosion that may result from exposure of the switch to such water.

15. The vehicle of claim 11, wherein:

the electrical connecting means comprise corrosion-resistant electrically conductive contact means, electrically connected to the motor and positioned to contact the terminals of such a battery when such a battery is mounted in the frame, to effect operative electrical connection between such a battery and the motor;

said contact means including an electrical on-off switch that is fixed to the frame and that has a self-wiping action that protects the switch against any corrosion that may result from exposure of the switch to such water.

16. An amphibious miniature wheeled toy vehicle for use with electrical battery means that comprise an elongated dry-cell battery having a longitudinal axis, and for operation along the surface of a pool of water as well as on a steep, irregular nonwater surface; said vehicle having, when such battery means are in use therewith, major weight components positioned to provide a generally symmetrical, compact, balanced and relatively low arrangement; said vehicle comprising:

a chassis having upright walls defining an interior compartment;

wheel means that include front wheel means and rear wheel means mounted to the chassis for rolling rotation about respective mutually parallel but spaced-apart from and rear axes, the distance between the front and rear axes being generally about two inches;

an electric motor that is mounted in the interior compartment, and that has a driveshaft;

means mounted in the interior compartment to releasably support such electrical battery means in the compartment with such longitudinal axis of such battery means extending substantially front-to-back of the vehicle and extending at least substantially the full distance between the front and rear axes;

means on the chassis for electrically connecting such battery means, when supported in the supporting means, to the motor, so that such battery means power the motor; and transmission means mounted in the interior compartment and comprising a speed-reduction mechanism connecting the motor driveshaft to both said front and said rear wheel means to transmit rotation from the driveshaft to the wheel means with reduced speed and with increased power;

at least major portions of the transmission means, the motor, and such battery means, when such battery means are supported in the supporting means, being at approximately the same height as the front and rear wheel means; and the transmission means, the motor and such battery means, when such battery means are supported in the supporting means, substantially fully occupying the interior compartment.

17. The vehicle of claim 16, also comprising:

a flotation chamber that is generally coextensive in width and length with the chassis, and that is disposed below the chassis.

18. The vehicle of claim 17, wherein:

the electrical connecting means comprise corrosion-resistant electrically conductive contact means, electrically connected to the motor and positioned to contact the terminals of such a battery when such a battery is mounted in the chassis, to effect operative electrical connection between such a battery and the motor;

said contact means including an electrical on-off switch that is fixed to the chassis and that has a self-wiping action that protects the switch against any corrosion that may result from exposure of the switch to such water.

19. An amphibious miniature toy vehicle, for use with an electrical battery to power the vehicle, and for operation along the surface of a pool of water and on a steep, irregular nonwater surface, for use with electrical battery means that comprise an elongated dry-cell battery having a longitudinal axis; said vehicle having, when such battery means are in use therewith, major weight components positioned to provide a generally symmetrical, compact, balanced and relatively low arrangement; said vehicle comprising:

a frame, which is so configured that when the vehicle operates in such a pool of water some of such water enters the frame;

wheel means mounted to the frame for rolling rotation and extending below the frame to effect propulsion of the vehicle along such nonwater surface;

an electric motor mounted to the frame and operatively connected to drive at least one of the wheel means;

means for operatively mounting such an electrical battery on the frame to power the motor; and corrosion-resistant electrically conductive contact means fixed to the frame, electrically connected to the motor, and positioned to contact the terminals of such a battery when such a battery is mounted in the frame, to effect operative electrical connection between such a battery and the motor;

said contact means including an electrical on-off switch that is fixed to the frame and that has a self-wiping action that protects the switch against any corrosion that may result from exposure of the switch to such water; and wherein:

the frame defines a chassis having upright walls defining an interior compartment;

the wheel means comprise front wheel means and rear wheel means mounted to the chassis for said rolling rotation about respective mutually parallel but spaced-apart front and rear axes, the distance between the front and rear axes being generally about two inches;

the electric motor is mounted in the interior compartment, and has a driveshaft;

the battery-mounting means are mounted in the interior compartment and adapted to releasably support such electrical battery means in the compartment with such longitudinal axis of such battery means extending substantially front-to-back of the vehicle and extending at least substantially the full distance between the front and rear axes;

the conductive contact means serve as means on the chassis for electrically connecting such battery means, when supported in the supporting means, to the motor, so that such battery means power the motor; and the vehicle further comprises:

transmission means mounted in the interior compartment and comprising a speed-reduction mechanism connecting the motor driveshaft to both said front and said rear wheel means to transmit rotation from the driveshaft to the wheel means with reduced speed and with increased power;

at least major portions of the transmission means, the motor, and such battery means, when such battery means are supported in the supporting means, being at approximately the same height as the front and rear wheel means; and the transmission means, the motor, and such battery means, when such battery means are supported in the supporting means, substantially fully occupying the interior compartment.

20. The vehicle of claim 19 wherein the contact means and included switch comprise:

a first corrosion-resistant formed metal contact fixed to the frame, disposed and adapted for electrical contact with one terminal of such a dry cell when such a dry cell is in place in the frame, and having a springy portion;

a second corrosion-resistant formed metal contact fixed to the frame, disposed and adapted for electrical contact with the motor, and having a springy portion; and a bridging corrosion-resistant formed metal contact that is slidably fixed to the frame and that when actuated slides between:

a first position in which it is not touching at least one of the first and second contacts and a second position in which it does touch both the first and second contacts at their respective springy portions; and wherein the springy portions press firmly against the bridging contact when the bridging contact is in the second position; and the direction of motion of the bridging contact relative to the directions in which the springy portions press is such that in the course of its sliding motion the bridging contact firmly wipes the springy portions of the first and second contacts where they touch the bridging contact.

21. An miniature amphibious wheeled toy vehicle for use with electrical battery means that comprise an elongated dry-cell battery having a longitudinal axis, and for operation along the surface of a pool of water as well as on a steep, irregular nonwater surface; said vehicle having, when such battery means are in use therewith, major weight components positioned to provide a generally symmetrical, compact, balanced and relatively low arrangement; said vehicle comprising:

a chassis having an extended rectangular bottom surface and raised walls at both sides, and at front and rear; and defining an interior compartment;

a flotation chamber affixed to the chassis and generally coextensive with the rectangular bottom surface of the chassis, and adapted and sized to contribute significantly to flotation of the vehicle in such water, but not communicating with the interior compartment; and having:

walls that are substantially extensions of the walls of the chassis, an extended rectangular floor, means defining a drain hole, and a sealing plug removably seated in the hole;

substantially hollow front wheel means and substantially hollow rear wheel means mounted to the chassis for rolling rotation about respective mutually parallel but spaced-apart front and rear axes, the distance between the front and rear axes being generally about two inches;

four cleated tires, one mounted to each wheel means, respectively, the cleats being adapted and sufficiently pronounced to propel the vehicle along such a water surface when approximately the bottom half of each wheel means is submerged in such water and approximately the top half of each wheel means is above such water;

an electric motor mounted in the interior compartment, and having a driveshaft;

means mounted in the interior compartment to releasably support such electrical battery means in the compartment with such longitudinal axis of such battery means extending substantially front-to-back of the vehicle and extending at least substantially the full distance between the front and rear axes;

means on the chassis for electrically connecting such battery means, when supported in the supporting means, to the motor, so that such battery means power the motor; said connecting means comprising:

corrosion-resistant electrically conductive contact means, electrically connected to the motor and positioned to contact the terminals of such a battery when such a battery is mounted in the frame, to effect operative electrical connection between such a battery and the motor;

said contact means including an electrical on-off switch that is fixed to the frame and that has a self-wiping action that protects the switch against any corrosion that may result from exposure of the switch to such water; and transmission means mounted in the interior compartment and comprising a speed-reduction mechanism connecting the motor driveshaft to both said front and said rear wheel means to transmit rotation from the driveshaft to the wheel means with reduced speed and with increased power;

at least major portions of the transmission means, the motor, and such battery means, when such battery means are supported in the supporting means, being at approximately the same height as the front and rear wheel means; and the transmission means, the motor, and such battery means, when such battery means are supported in the supporting means, substantially fully occupying the interior compartment.

22. The toy vehicle of claim 21 wherein the speed-reduction means provide a mechanical advantage between the motor driveshaft and both the front and rear wheel means that is between 55:1 and 65:1.

23. A self-propelled amphibious miniature toy vehicle for operation along the surface of a pool of water and on a steep, irregular nonwater surface, said vehicle having major weight components positioned to provide weight in a generally balanced and relatively low arrangement; said vehicle comprising:

a frame;

hollow wheel means mounted to the frame for rolling rotation and extending below the frame to effect propulsion of the vehicle along such nonwater surface, the volume-to-weight ratio of each of said wheel means being sufficiently high to contribute significantly to flotation of the vehicle in water; and an electric motor mounted to the frame and operatively connected to drive at least one of the wheel means; and wherein:

the hollow wheel means comprise hollow front wheel means and hollow rear wheel means mounted to the frame for said rolling rotation about respective mutually parallel but spaced-apart front and rear axes, the distance between the front and rear axes being generally about two inches, each of said wheel means having high-friction peripheral surfaces with inside edges located respectively adjacent to opposite sides of said frame;

the electric motor has a driveshaft which extends from the motor; and the vehicle further comprises:

means mounted to the frame to releasably support electrical battery means, the battery means being adjacent to the electric motor and at approximately the same height as said front and rear wheel means, and wherein said frame, said motor and said battery means do not protrude any appreciable distance below the level of said front and rear axes in the area between said front and rear wheel means;

means for electrically connecting such battery means, when supported in the supporting means, to the motor, so that the battery means power the motor;

at least one worm rotatably mounted to the frame and powered from the driveshaft; and at least one worm gear rotatably mounted to the frame, and driving at least one of the wheel means, and being meshed with and directly driven from the worm.

24. The vehicle of claim 23, also comprising:

cleated tires mounted to the wheel means, the cleats being adapted and sufficiently pronounced to propel the vehicle along such a water surface when approximately the bottom half of each wheel means is submerged in such water and approximately the top half of each wheel means is above such water; and a toy vehicle body mounted to the frame, said body:

concealing the motor, worms, worm gears and dry-cell mounting means; and being a scale model derived from at least one real vehicle body;

said axes of wheel-means rotation being spaced apart to generally match the axle spacing of such a real vehicle at the scale used; and the outside diameter of the tires being at least three times overscale.

25. The vehicle of claim 24, also comprising a separate flotation chamber affixed to the frame and adapted and sized to contribute significantly to flotation of the vehicle in such water.

26. The vehicle of claim 25, wherein the flotation chamber is generallly coextensive in width and length with the frame, and disposed below the frame.

27. The vehicle of claim 26, wherein:

the electrical connecting means comprise corrosion-resistant electrically conductive contact means, electrically connected to the motor and positioned to contact the terminals of such a battery when such a battery is mounted in the frame, to effect operative electrical connection between such a battery and the motor;

said contact means including an electrical on-off switch that is fixed to the frame and that has a self-wiping action that protects the switch against any corrosion that may result from exposure of the switch to such water.

28. The vehicle of claim 24, wherein:

the electrical connecting means comprise corrosion-resistant electrically conductive contact means, electrically connected to the motor and positioned to contact the terminals of such a battery when such a battery is mounted in the frame, to effect operative electrical connection between such a battery and the motor;

said contact means including an electrical on-off switch that is fixed to the frame and that has a self-wiping action that protects the switch against any corrosion that may result from exposure of the switch to such water.

29. The vehicle of claim 23 also comprising a separate flotation chamber affixed to the frame and adapted and sized to contribute significantly to flotation of the vehicle in such water.

30. The vehicle of claim 29, wherein the flotation chamber is generally coextensive in width and length with the frame, and disposed below the frame.

31. The vehicle of claim 30, wherein:

the electrical connecting means comprise corrosion-resistant electrically conductive contact means, electrically connected to the motor and positioned to contact the terminals of such a battery when such a battery is mounted in the frame, to effect operative electrical connection between such a battery and the motor;

said contact means including an electrical on-off switch that is fixed to the frame and that has a self-wiping action that protects the switch against any corrosion that may result from exposure of the switch to such water.

32. The vehicle of claim 23, wherein:

the electrical connecting means comprise corrosion-resistant electrically conductive contact means, electrically connected to the motor and positioned to contact the terminals of such a battery when such a battery is mounted in the frame, to effect operative electrical connection between such a battery and the motor;

said contact means including an electrical on-off switch that is fixed to the frame and that has a self-wiping action that protects the switch against any corrosion that may result from exposure of the switch to such water.

33. A self-propelled amphibious miniature toy vehicle for operation along the surface of a pool of water and on a steep, irregular nonwater surface, said vehicle having major weight components positioned to provide weight in a generally balanced and relatively low arrangement, while also providing adequate ground clearance in the area between the front and rear wheels, said vehicle comprising:

a frame;

wheel means mounted to the frame for rolling rotation and extending below the frame to effect propulsion of the vehicle along such nonwater surface;

an electric motor mounted to the frame and operatively connected to drive at least one of the wheel means; and cleated tires mounted to the wheel means, the cleats being adapted and sufficiently pronounced to propel the vehicle along such a water surface when generally the bottom half of each wheel means is submerged in such water and generally the top half of each wheel means is above such water; and wherein:

the overall flotation characteristics of the vehicle are such that when the vehicle is placed in a sufficiently deep pool of water the vehicle floats with generally the bottom half of each wheel means submerged in such water and generally the top half of each wheel means above such water;

the wheel means comprise front wheel means and rear wheel means mounted to the frame for said rolling rotation about respective mutually parallel but spaced-apart front and rear axes, the distance between the front and rear axes being generally about two inches, each of said wheel means having high-friction peripheral surfaces with inside edges located respectively adjacent to opposite sides of said frame;

the electric motor has a driveshaft which extends from the motor; and the vehicle further comprises:

means mounted to the frame to releasably support electrical battery means, the battery means being adjacent to the electric motor and at approximately the same height as said front and rear wheel means, and wherein said frame, said motor and said battery means do not protrude any appreciable distance below the level of said front and rear axes in the area between said front and rear wheel means;

means for electrically connecting such battery means, when supported in the supporting means, to the motor, so that the battery means power the motor;

at least one worm rotatably mounted to the frame and powered from the driveshaft;

at least one worm gear rotatably mounted to the frame, and driving at least one of the wheel means, and being meshed with and directly driven from the worm; and cleated tires mounted to the wheel means, the cleats being adapted and sufficiently pronounced to propel the vehicle along such a water surface when approximately the bottom half of each wheel means is submerged in such water and approximately the top half of each wheel means is above such water.

34. The vehicle of claim 33 also comprising a separate flotation chamber affixed to the frame and adapted and sized to contribute significantly to flotation of the vehicle in such water.

35. The vehicle of claim 34, wherein the flotation chamber is generally coextensive in width and length with the frame, and disposed below the frame.

36. The vehicle of claim 34, wherein:

the electrical connecting means comprise corrosion-resistant electrically conductive contact means, electrically connected to the motor and positioned to contact the terminals of such a battery when such a battery is mounted in the frame, to effect operative electrical connection between such a battery and the motor;

said contact means including an electrical on-off switch that is fixed to the frame and that has a self-wiping action that protects the switch against any corrosion that may result from exposure of the switch to such water.

37. The vehicle of claim 32, wherein:

the electrical connecting means comprise corrosion-resistant electrically conductive contact means, electrically connected to the motor and positioned to contact the terminals of such a battery when such a battery is mounted in the frame, to effect operative electrical connection between such a battery and the motor;

said contact means including an electrical on-off switch that is fixed to the frame and that has a self-wiping action that protects the switch against any corrosion that may result from exposure of the switch to such water.

38. A self-propelled amphibious miniature toy vehicle for operation along the surface of a pool of water and on a steep, irregular nonwater surface, said vehicle having major weight components positioned to provide weight in a generally balanced and relatively low arrangement; said vehicle comprising:

a frame;

wheel means mounted to the frame for rolling rotation and extending below the frame to effect propulsion of the vehicle along such nonwater surface;

an electric motor mounted to the frame and operatively connected to drive at least one of the wheel means; and a separate flotation chamber affixed to the frame and adapted and sized to contribute significantly to flotation of the vehicle in such water; and wherein:

the wheel means comprise front wheel means and rear wheel means mounted to the frame for rolling rotation about respective mutually parallel but spaced-apart front and rear axes, the distance between the front and rear axes being generally about two inches, each of said wheel means having high-friction peripheral surfaces with inside edges located respectively adjacent to opposite sides of said frame;

the electric motor has a driveshaft which extends from the motor; and the vehicle further comprises:

means mounted to the frame to releasably support electrical battery means, the battery means being adjacent to the electric motor and at approximately the same height as said front and rear wheel means, and wherein said frame, said motor and said battery means do not protrude any appreciable distance below the level of said front and rear axes in the area between said front and rear wheel means;

means for electrically connecting such battery means, when supported in the supporting means, to the motor, so that the battery means power the motor;

at least one worm rotatably mounted to the frame and powered from the driveshaft; and at least one worm gear rotatably mounted to the frame, and driving at least one of the wheel means, and being meshed with and directly driven from the worm.

39. The vehicle of claim 38, wherein the flotation chamber is generally coextensive in width and length with the frame, and disposed below the frame.

40. The vehicle of claim 38, wherein:

the electrical connecting means comprise corrosion-resistant electrically conductive contact means, electrically connected to the motor and positioned to contact the terminals of such a battery when such a battery is mounted in the frame, to effect operative electrical connection between such a battery and the motor;

said contact means including an electrical on-off switch that is fixed to the frame and that has a self-wiping action that protects the switch against any corrosion that may result from exposure of the switch to such water.

41. A self-propelled amphibious miniature toy vehicle for operation along the surface of a pool of water and on a steep, irregular nonwater surface, having major weight components positioned to provide weight in a generally balanced and relatively low arrangement; said vehicle comprising:

a frame;

wheel means mounted to the frame for rolling rotation and extending below the frame to effect propulsion of the vehicle along such nonwater surface;

an electric motor mounted to the frame and operatively connected to drive at least one of the wheel means; and a separate flotation chamber affixed to the frame and adapted and sized to contribute significantly to flotation of the vehicle in such water; and wherein:

the wheel means comprise front wheel means and rear wheel means mounted to the frame for said rolling rotation about respective mutually parallel but spaced-apart front and rear axes, the distance between the front and rear axes being generally about two inches, each of said wheel means having high-friction peripheral surfaces with inside edges located respectively adjacent to opposite sides of said frame;

the electric motor has a driveshaft which extends from the motor;

the battery-mounted means are mounted to the frame and adapted to releasably support such electrical battery, the battery being adjacent to the electric motor and at approximately the same height as said front and rear wheel means, and wherein said frame, said motor and said battery do not protrude any appreciable distance below the level of said front and rear axes in the area between said front and rear wheel means;

the contact means serve as means for electrically connecting such battery to power the motor; and the vehicle further comprises:

at least one worm rotatably mounted to the frame, and driven from the driveshaft;

at least one worm gear rotatably mounted to the frame, and driving at least one of the wheel means, and being meshed with and directly driven from the worm.

42. The vehicle of claim 41 wherein the contact means and included switch comprise:

a first corrosion-resistant formed metal contact fixed to the frame, disposed and adapted for electrical contact with one terminal of such a dry cell when such a dry cell is in place in the frame, and having a springy portion;

a second corrosion-resistant formed metal contact fixed to the frame, disposed and adapted for electrical contact with the motor, and having a springy portion; and a bridging corrosion-resistant formed metal contact that is slidably fixed to the frame and that when actuated slides between:

a first position in which it is not touching at least one of the first and second contacts and a second position in which it does touch both the first and second contacts at their respective springy portions; and wherein the springy portions press firmly against the bridging contact when the bridging contact is in the second position; and the direction of motion of the bridging contact relative to the directions in which the springy portions press is such that in the course of its sliding motion the bridging contact firmly wipes the springy portions of the first and second contacts where they touch the bridging contact.

* * * * *